US010662621B2

(12) United States Patent
Rausch et al.

(10) Patent No.: US 10,662,621 B2
(45) Date of Patent: May 26, 2020

(54) CONTROL OF VARIABLE GRAVITY DRIVEN HYDRAULIC LOADS

(71) Applicant: Deere & Company, Moline, IL (US)

(72) Inventors: Bryan Rausch, Dubuque, IA (US); Todd F. Velde, Dubuque, IA (US); Sean Mairet, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 312 days.

(21) Appl. No.: 15/811,773

(22) Filed: Nov. 14, 2017

(65) Prior Publication Data

US 2019/0145083 A1 May 16, 2019

(51) Int. Cl.

| | |
|---|---|
| ***E02F 9/22*** | (2006.01) |
| ***F15B 13/042*** | (2006.01) |
| ***F15B 11/15*** | (2006.01) |
| ***F15B 11/04*** | (2006.01) |

(52) U.S. Cl.

CPC ..... *E02F 9/2228* (2013.01); *F15B 11/04* (2013.01); *F15B 11/15* (2013.01); *F15B 13/0422* (2013.01)

(58) Field of Classification Search

CPC ..... E02F 9/2228; E02F 9/2019; E02F 3/431; F15B 13/0422; F15B 11/15; F15B 11/04

See application file for complete search history.

(56) References Cited

U.S. PATENT DOCUMENTS

| | | | | |
|---|---|---|---|---|
| 5,960,695 | A | 10/1999 | Aardema et al. | |
| 6,185,493 | B1 * | 2/2001 | Skinner | E02F 3/432 701/50 |
| 6,257,118 | B1 * | 7/2001 | Wilbur | E02F 9/2203 137/625.65 |
| 8,442,730 | B2 * | 5/2013 | Okamura | E02F 9/2207 701/50 |
| 2002/0162327 | A1 | 11/2002 | Stephenson et al. | |
| 2004/0016556 | A1 | 1/2004 | Barber | |
| 2006/0218915 | A1 * | 10/2006 | Dix | F15B 21/08 60/469 |
| 2009/0142201 | A1 | 6/2009 | Lin et al. | |
| 2013/0167522 | A1 | 7/2013 | Oguma et al. | |
| 2014/0260222 | A1 | 9/2014 | Yahner | |

FOREIGN PATENT DOCUMENTS

| | | | |
|---|---|---|---|
| JP | 10-68145 | * | 3/1998 |

* cited by examiner

*Primary Examiner* — Michael J Zanelli

(57) ABSTRACT

A system for controllably moving a work implement of a work vehicle having a hydraulic fluid pump for providing fluid to the work implement, the system comprising: at least one operator command tool to produce an operator command signal to move the implement of the work vehicle; at least one sensor to sense a cylinder speed signal indicative of a speed of a hydraulic cylinder coupled to the implement; at least one valve to modulate the fluid flow of the hydraulic cylinder; and a controller.

18 Claims, 5 Drawing Sheets

CONTROL OF VARIABLE GRAVITY DRIVEN HYDRAULIC LOADS

CROSS-REFERENCE TO RELATED APPLICATIONS

N/A

FIELD OF THE DISCLOSURE

The present disclosure relates to a method and system for controlling the movement of a work implement of a work vehicle and, more particularly the method and system that controls the movement of the work implement.

BACKGROUND

Work vehicles such as wheel drive loaders, backhoes, excavators, and skid steers include work implements capable of being moved through a number of positions during a work cycle. Such implements include buckets, forks, and other material handling apparatus. The typical work cycle associated with a bucket includes sequentially positioning the bucket and associated lift arm in a digging position for filling the bucket with material, a carrying position, a raised position, and a dumping position for removing material from the bucket. Each of these movements are subject to highly variable gravity driven loads The present disclosure is directed towards overcoming the problems set forth with the movement of highly variable gravity driven loads and others not explicitly mentioned.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes a method for controllably moving a work implement of a work vehicle having a hydraulic fluid pump for providing a fluid flow to the work implement, the work implement including a plurality of work functions that includes a lifting and a lowering function through modulating fluid flow to a hydraulic cylinder through at least one valve.

According to an aspect of the present disclosure, the method for controllably moving a work implement of a work vehicle may include one or more of the following steps: generating an operator signal to move the implement on the work vehicle and converting the operator command in a speed command signal; sensing a cylinder speed signal indicative of a speed of a hydraulic cylinder, and generating a corresponding output cylinder velocity signal in response to the speed command signal and the cylinder speed signal; receiving the output cylinder velocity signal, and generating a corresponding electrical valve signal; receiving the electrical valve signal and controllably modifying a cross-section of the at least one valve to modulate the fluid flow of the hydraulic cylinder to move the hydraulic cylinder in accordance with the speed command signal.

The cylinder speed signal may be derived from a cylinder position sensor or a state observer. The state observer may include an algorithm adapted to run on a controller.

The method may further include the following steps: sensing a load signal indicative of a load on the hydraulic cylinder; and receiving the load signal and generating a corresponding electrical valve signal based on the load signal and the output cylinder velocity signal.

Modification of the cross-section of the valve may include modifying a cross-section of a supply valve from the hydraulic fluid pump or modifying a cross-section of a return valve to the fluid tank or both.

The aforementioned method may apply to an open center hydraulic system which includes an open center control valve.

Furthermore, generating a corresponding electrical valve signal may further comprise receiving a signal indicative of the availability of the fluid flow to the hydraulic cylinder.

According to another aspect of the present disclosure, a system for controllably moving a work implement of a work vehicle having a hydraulic fluid pump for providing a fluid flow to the work implement may include one or more of the following: at least one operator command tool to produce an operator command signal to move the implement of the work vehicle; at least one sensor to sense a cylinder speed signal indicative of a speed of a hydraulic cylinder coupled to the implement; at least one valve to modulate fluid flow of the hydraulic cylinder; and a controller, having one or more processors that: process the operator command signal to convert the operator command signal into a speed command signal; process the cylinder speed signal to generate a corresponding output cylinder velocity signal in response to the speed command signal and the cylinder speed signal; and generate an electrical valve signal corresponding to the output cylinder velocity signal to controllably modify the cross-section of at least one valve. Generation of the electrical valve signal may further comprise receiving a signal indicative of the availability of the fluid flow to the hydraulic cylinder.

The sensor of the system may be cylinder position sensor or a state observer.

The operator command tool of the system may include one or more of joystick, a button, a touchscreen, or a pedal.

The valve of the system may include one or more of a directional control valve, a proportional control valve, a pressure control valve, and a flow control valve.

Controllably modifying the cross-section the valve of the system may include modifying a cross-section of a supply valve from the hydraulic fluid pump or modifying a cross-section of the return valve to the fluid tank or both.

The system may further include at least one load sensor to sense a load signal indicative of a load on the hydraulic cylinder, and where the controller further processes the load signal to generate a corresponding output cylinder velocity.

The system may further comprise an open center control valve.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

Figure 1:
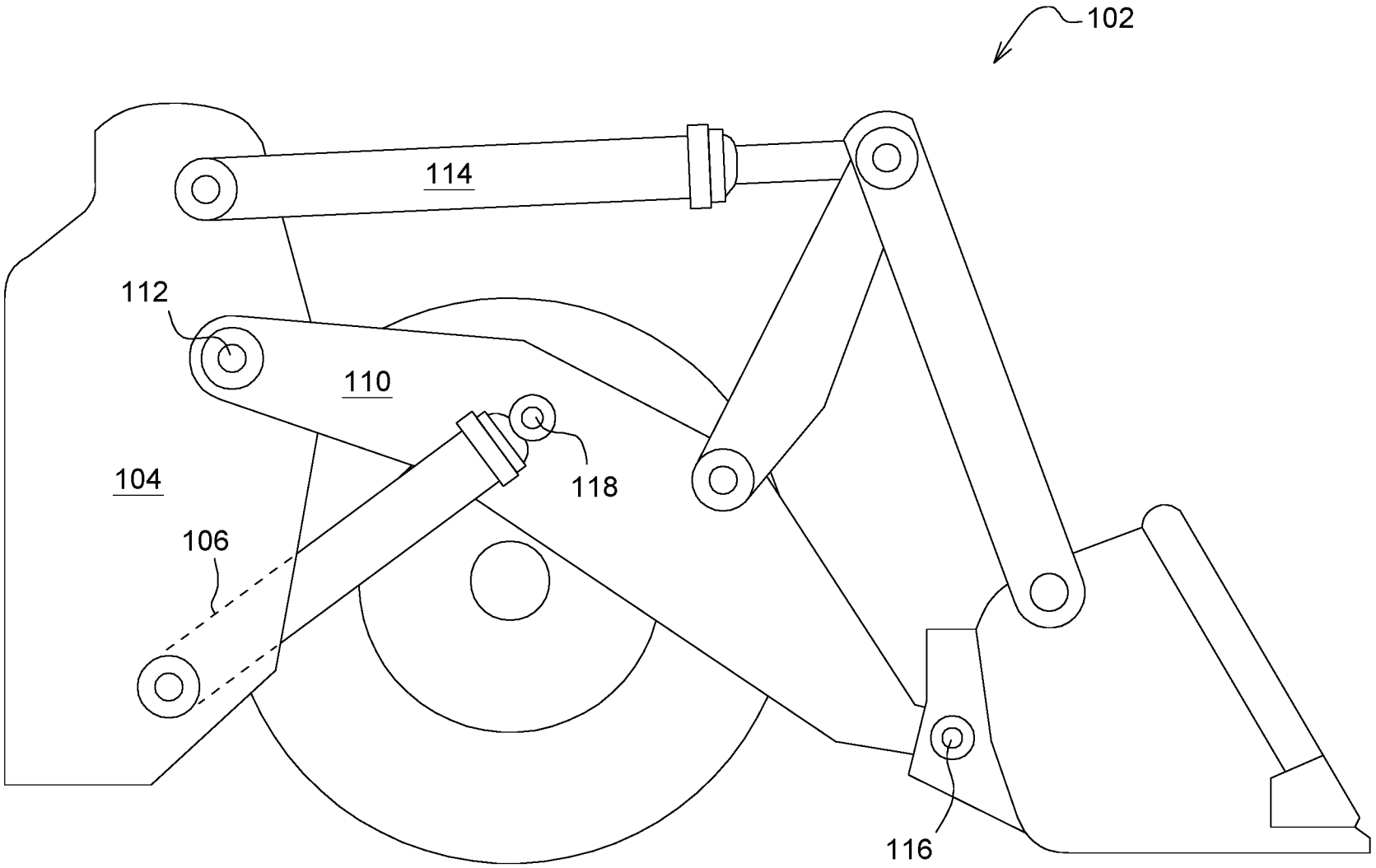
FIG. 1 is a side view of a forward portion of a loader.

FIG. 1 illustrates a forward portion of a work vehicle 104 having a work implement 102 in the form of a bucket 108. Although the present invention is described in relation to work vehicle with a bucket 108, the present disclosure is equally applicable to numerous work vehicles with work implements 102 capable of being moved through a number of a positions during a work cycle, such as wheel drive loaders, excavators, and skid steers. Such implements include buckets, forks, and other material handling apparatus. The bucket 108 is connected to a lift arm assembly or boom 110, which is pivotally actuated by two hydraulic lift actuators or hydraulic cylinders 106 (only one of which is shown) about a boom pivot pin 112 that is attached to the machine frame. A boom load bearing pivot pin 118 is attached to the boom 110 and the lift cylinders 106. The bucket 108 is tilted by a bucket tilt actuator or tilt cylinder 114 about a tilt pivot pin 116.

A typical work cycle associated with a bucket includes sequentially positioning the bucket and associated lift arm assemblies in a digging position for filling the bucket with material, a carrying position, a raised position, and a dumping position for removing material from a bucket. Each of these movements are subject to highly variable gravity driven loads. A common method to maintain control of the speed of the implement regardless of the weight of the load is to add a fixed significant restriction on the return line through a return valve sized such that at maximum loads the fluid flow or pressure is minimal while preventing cavitation in the hydraulic cylinder. However, as a result, a large hydraulic fluid pump pressure is required to force fluid flow 210 through the fixed restriction on the return line (i.e. the return valve 295) to maintain cycle times. Consequently, a large parasitic load a large parasitic power loss is created thereby resulting in an inefficient system. Furthermore, stresses are produced when the machine is in lowering mode and the return line is quickly restricted. The inertia of the load and implement exert forces on the lift arm assemblies and hydraulic components when the return line is quickly closed and the motion is abruptly stopped. Such stops cause increased wear on the work vehicle and reduce operator comfort. In some situations, the rear of the work vehicle may even be raised off the ground.

Figure 2:
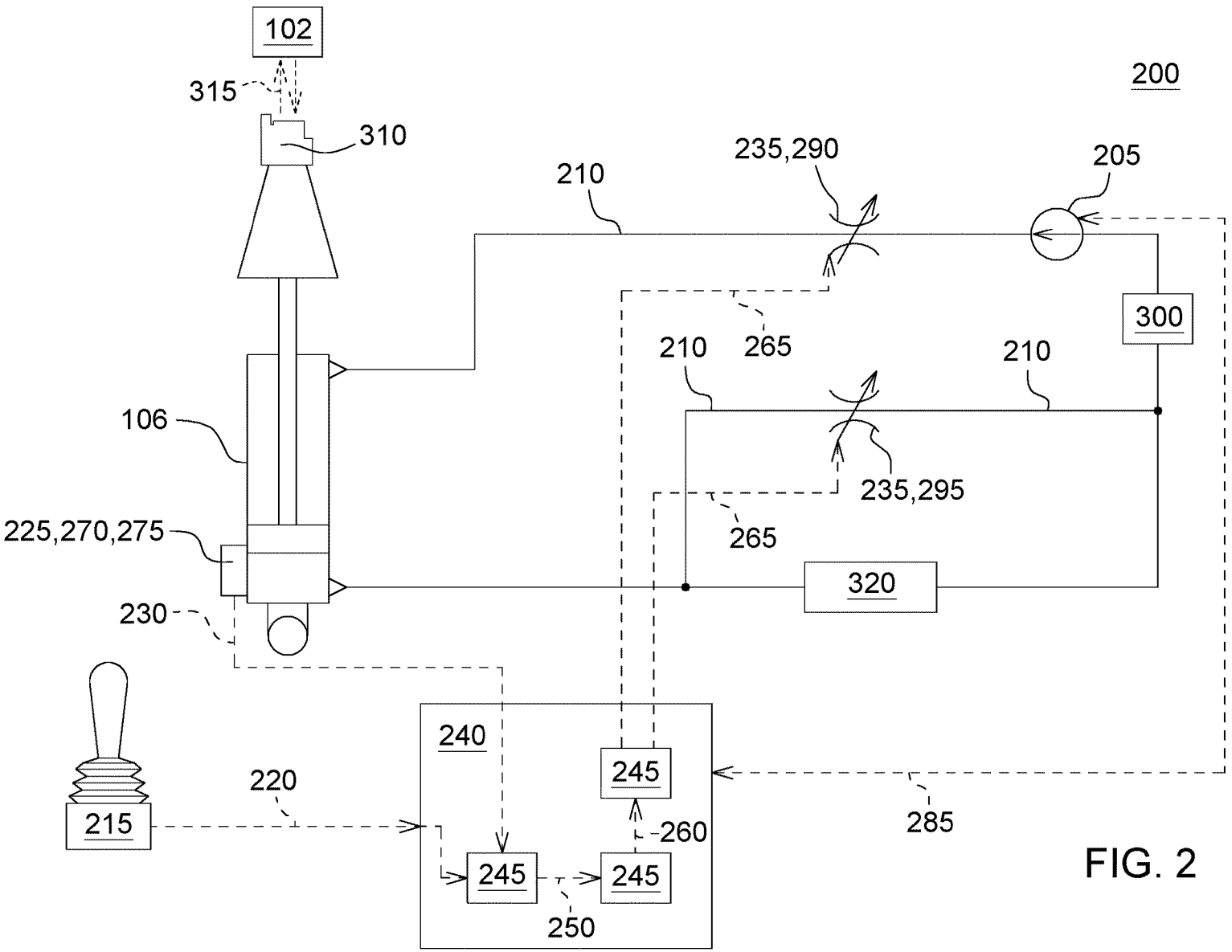
FIG. 2 is a schematic one embodiment of the control system to move a work implement of a work vehicle having a fluid hydraulic pump for providing fluid flow to the work implement.

FIG. 2 is a schematic of a control system 200 designed to address the aforementioned issue with respect to implement 102 control. The control system 200 is adapted to sense a plurality of inputs and responsively produce output signals which are delivered to various actuators in the control system 200. The system 200 is for controllably moving a work implement 102 of a work vehicle 104 having a hydraulic fluid pump 205 for providing a fluid flow 210 to the implement 102. The system 200 comprises at least one operator command tool 215 to produce an operator command signal 220 to move the implement 102 of the work vehicle 104; at least one sensor 225 to sense a cylinder speed signal 230 indicative of a speed of a hydraulic cylinder 106 coupled to the implement 102; at least one valve 235 to modulate the fluid flow 210 (as shown in the solid lines connecting elements in FIG. 2) of the hydraulic cylinder 106; and a controller 240, having one or more processors 245. The processors 245 process the operator command signal 220 to convert the operator command signal 220 into a speed command signal 250; process the cylinder speed signal 230 to generate a corresponding output cylinder velocity signal 260 in response to the speed command signal 250 and the cylinder speed signal 230; and generate an electrical valve signal 265 corresponding to the output cylinder velocity signal 260 to controllably modify a cross-section of the valve 235.

The operator command tool 215 provides operator control over the work implement 102. In FIG. 2, the operator command tool 215 is shown as a joystick, or a control lever that has movement along a single axis. Although the system 200 shows a simplified schematic demonstrating the embodiment with only one operator command tool 215, the system 200 may comprise a plurality of operator command tools 215 correlating to one or a plurality of implements. For example, a first joystick may control the lifting operation of the boom 110; a second joystick may control the tilting operation of the bucket 108; and a third joystick may control an auxiliary function, such as operation of a special work tool. Furthermore, the operator command tool 215 may come in alternative forms such as a button, a touchscreen, a pedal, or a subsystem utilizing voice command.

The operator command tool 215 creates an operator command signal 220. The operator command signal 220 is indicative of the desired velocity of the respective hydraulic cylinder 106. This operator command signal 220 feeds into a processor 245 of the controller 240 and converts it to a speed command signal 250.

A sensor 225 on the hydraulic cylinder 106 senses a signal indicative of the velocity of the lift 106 and tilt cylinders 114 (shown in FIG. 1) coupled to the implement 102, and transmits that signal to a processor 245 of controller 240. The sensor 225 may be a cylinder position sensor 270 wherein the sensor 225 receives position signals of the respective hydraulic cylinder 106, differentiates the position signals, and senses the respective cylinder speed signal 230. The processor 245 generates a corresponding output cylinder velocity signal 260 in response to the speed command signal 250 and the cylinder speed signal 230.

In the alternative, the sensor 225 may be a state observer 275. A state observer 275 is a model of the system 200 controlled, used to estimate unmeasured variables based on known inputs and measured outputs. The state observer may include an algorithm adapted to run on the controller 240. In one embodiment, the state observer may utilize a signal representative of fluid flow 210 through the valve 235 (a known input) and a signal representative of cylinder position (a known output) to effectively estimate the speed of a hydraulic cylinder 106. Advantageously, this approach minimizes the noise generated in a signal representative of cylinder position alone whereby calculation of unmeasured variables based on known inputs and outputs based on the model of the system 200 sets a predictive range over a period of time to correct the signal representative of cylinder position through a feedback mechanism; allows for the calculation of unmeasurable variables which may be used for other systems; and whereby the correction in the signal representative of cylinder position can be an indication of an unknown external disturbance (e.g. damaged component, leaks in the system, or the opening of a bypass relief valve).

The valve 235 is at least one of a directional control valve, a proportional control valve, a pressure control valve, and a flow control valve. Other alternative types of valves include spools, poppets, or solenoids. In any respect, the valve 235 is responsive to the electrical valve signal 265 generated by a processor 245 in the controller 240 to provide fluid flow 210 to the hydraulic cylinder 106. The electrical valve signal 265 may be modified by proportional, integral, or derivative gain values. Alternatively, the electrical valve signal 265 may be a limit on the valve command. FIG. 2 demonstrates a simplified system, showing a supply valve 290 positioned between the hydraulic fluid pump 205 and the hydraulic cylinder 106, and a return valve 295 positioned between the hydraulic cylinder 106 and the fluid tank 300. The fluid tank 300 is a reservoir capable of holding a quantity of fluid, wherein the fluid tank 300 is preferably a hydraulic fluid tank, and the fluid is a hydraulic fluid. The supply valve 290 is a valve connected downstream of the hydraulic fluid pump 205 and being movable between an open position, a closed position, or any position there between to regulate the pressure of the fluid, or fluid flow discharged by the hydraulic fluid pump 205.

Figure 3:
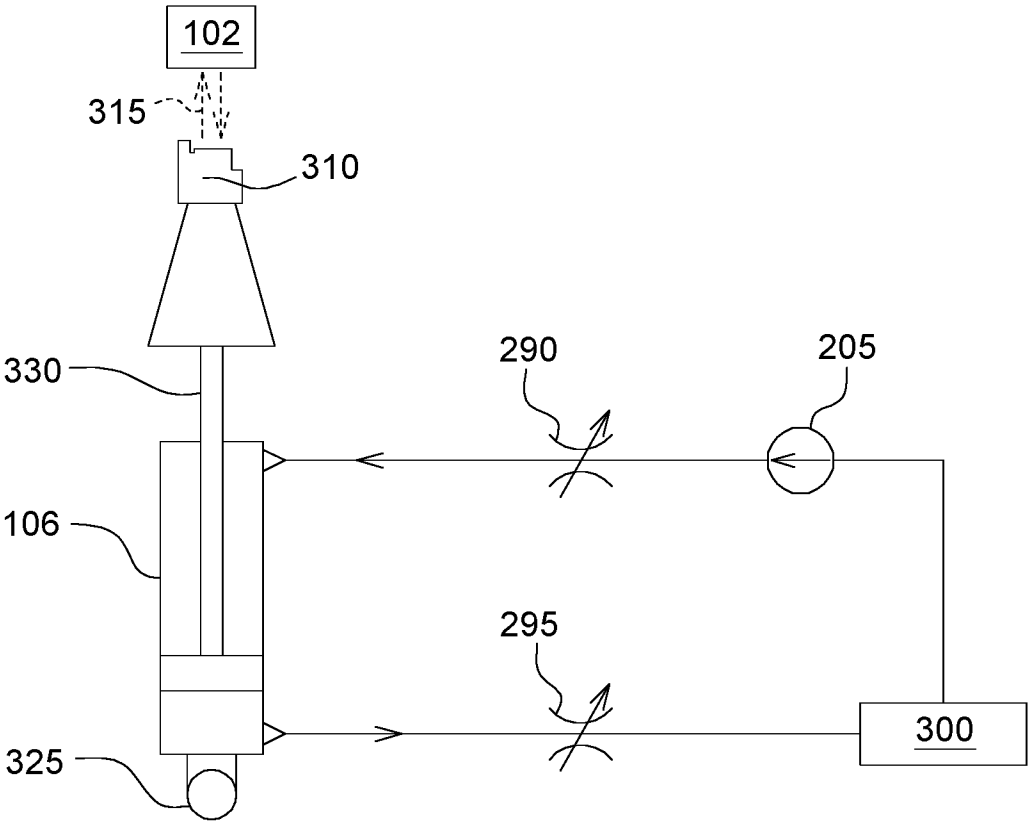
FIG. 3 is a schematic representative of a hydraulic cylinder to lift and lower a load.

Now turning to FIG. 3, is shown a simplified schematic representative of a hydraulic cylinder 106 to lift a load when extending and lower a load when retracting, wherein a head 325 and rod 330 are shown. The cylinder force is given by the equation $$p_h A_h - p_r A_r = F$$

where $p_h$, $p_r$ are the head 325 and rod 330 pressure (respectively) and $A_h$, $A_r$ are the head and rod areas. To lower the load in a controlled way, the return valve 295 (also shown in FIG. 2) must create a restriction that maintains a supporting pressure in the head 325 of the hydraulic cylinder 106. However, if the return valve 295 is excessively restrictive, the supply pressure (and subsequent opening of the supply valve 290) will need to increase in order to achieve the desired force and to lower the load. The pressure drop across the return valve represents lost energy. Because the load may vary, the valve position (i.e. open, closed, or a position there in between) required to lower the load in a controlled manner also varies. Current methods utilized a fixed restriction on the return valve 295, where the restriction is optimized for the heaviest loads in order to maintain control at any load. However, this results in suboptimal functioning at all other loads because of maximum parasitic losses from the pressure drop across the return valve. In the embodiment disclosed, the feedback control (as shown in detail in FIG. 2) on hydraulic cylinder velocity, wherein the output cylinder velocity generates a corresponding electrical valve signal 265 based on inputs, is used to allow the return valve 295 to open wider for lighter loads and restrict for heavier loads.

Advantageously, placement of a return valve 295 with the ability to modulate fluid flow 210 in incremental units improves the efficiency of the system, saves fuel, reduces wear on the system components, and provides other benefits while maintaining the required force to lower the load of an implement 102. This is especially true for open center hydraulic systems where the return valve 295 alone controls descent of a load. Modulation of the fluid flow through the return valve 295 correlates with the cylinder velocity.

Controllably modifying the cross-section of the at least one valve 235 comprises at least one of modifying a cross-section of a supply valve 290 from the hydraulic fluid pump 205 and modifying a cross-section of a return valve 295 to a fluid tank 300.

Now turning back to FIG. 2, the system 200 may further comprise at least one load sensor 310 to sense a load signal 315 indicative of a load on the hydraulic cylinder 106, and wherein the controller 240 further processes the load signal 315 to generate a corresponding output cylinder velocity 260. The load sensor 310 illustratively provides a signal 315 indicative of whether the bucket 108 is carrying a load. This can include a strain gauge sensor or a variety of other types of sensors.

The system may be an open center hydraulic system. That is, any fluid flow 210 in the system not used for a specific function (e.g. to steer the work vehicle, to operate the implement, to operate stabilizers, etc.) may be returned downstream to the fluid tank 300 through an open center control valve 320 when the function is in a neutral position. The fluid tank 300 and hydraulic fluid pump 205 is driven by the engine (not shown) to deliver pressurized fluid flow from the tank 300. An exemplary open center control valve 320 for use is the 6000 series valve available from HUSCO International, Inc. of Waukesha, Wis.

Generating the electrical valve signal 265 by the processor 245 may further comprise receiving a signal indicative of the availability of the fluid flow 210 to the hydraulic cylinder 106. The hydraulic fluid pump 205 delivers a pump pressure signal 285 to the controller 240. The controller 240 utilizes this information alongside with signals from various sensors through the system 200 to determine the availability of fluid flow 210 to the hydraulic cylinders 106, or in the instance of a loader, the fluid flow 210 availability to the lift 106, and tilt cylinders 114 (shown in FIG. 1).

Figure 4:
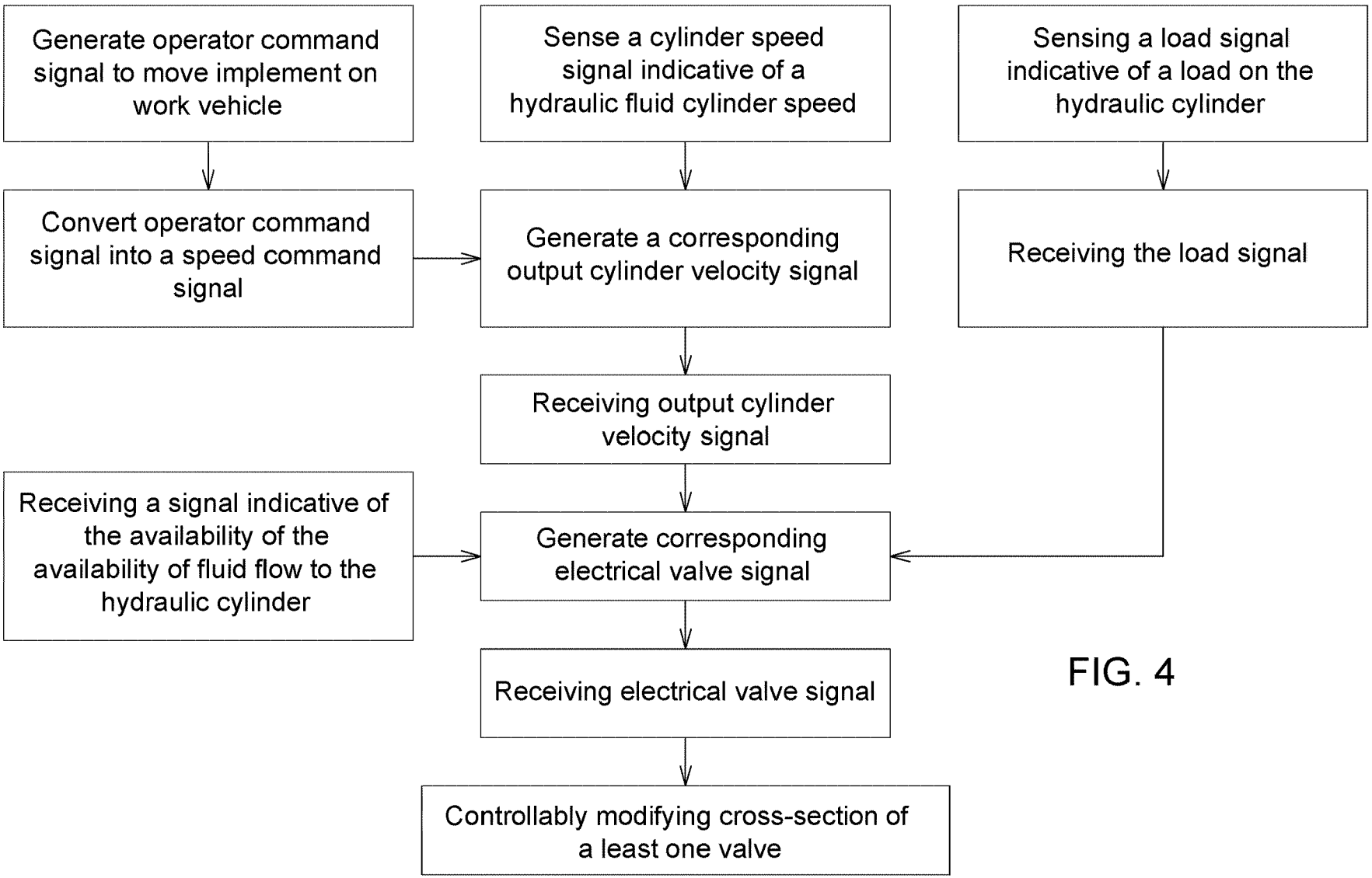
FIG. 4 is a flowchart on a method for controllably moving a work implement of a work vehicle having a hydraulic fluid pump for providing fluid flow to the work implement.

FIG. 4 is a flowchart exemplifying a method for controllably moving a work implement 102 of a work vehicle 104 having a hydraulic fluid pump 205 for providing a fluid flow 210 to the work implement 102, the work implement 102 including a plurality of work function that includes a lifting and a lowering function through modulating fluid to a hydraulic cylinder (110, 106) through at least one valve 235. The method may comprise generating an operator command signal 220 to move the implement 102 on the work vehicle 104 and converting the operator command signal 220 into a speed command signal 250; sensing a cylinder speed signal 230 indicative of a speed of a hydraulic cylinder, and generating a corresponding output cylinder velocity signal 260 in response to the speed command signal 250 and the cylinder speed signal 230; receiving the output cylinder velocity signal 260 and generating a corresponding electrical valve signal 265; and receiving the electrical valve signal 265 and controllably modifying a cross-section of the least one valve 235 to modulate the fluid flow 210 of the hydraulic cylinder to move the hydraulic cylinder in accordance with the speed command signal 250. The cylinder speed signal 230 may be derived from a cylinder position sensor 270 or a state observer 275. The state observer 275 may include an algorithm adapted to run on a controller 240. Controllably modifying the cross-section of a valve 235 may comprise of modifying at least one of a cross-section of a supply valve 290 and a cross-section of a return valve 295 to a fluid tank 300.

The method may further comprise sensing a load signal 315 indicative of a load on the hydraulic cylinder (106, 110), receiving the load signal 315 and generating a corresponding electrical valve signal 265 based on the load signal the output cylinder velocity signal.

According to the method, the fluid may flow through at least an open center control valve 320. Open center control valves are generally used in open center hydraulic systems.

Figure 5:
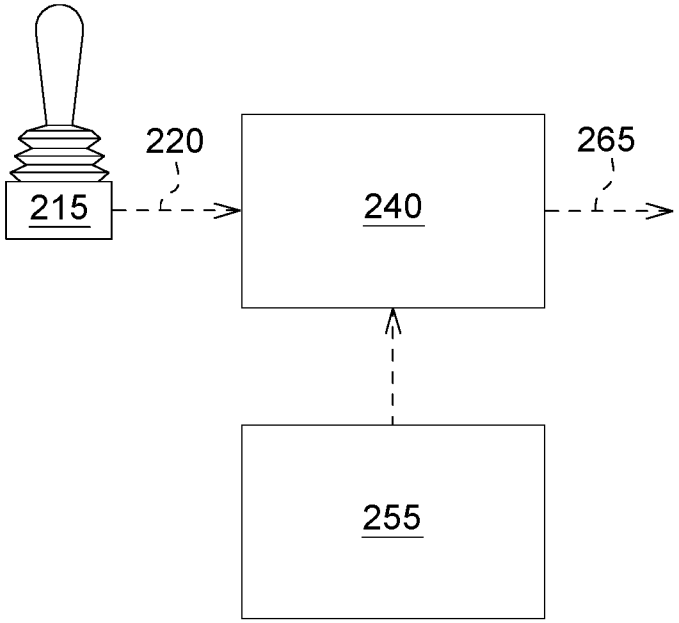
FIG. 5 is a high level schematic of an alternative embodiment where the electrical valve signal is a function of the operator command signal and feedback control mechanism.

FIG. 5 is a high level schematic where the electrical valve signal 265 to control at least one of the supply valve 290 and the return valve 295 is a function of the operator command signal 220 and the feedback control mechanism 255. As discussed above, the feedback control mechanism 255 may comprise of the valve command, an additive or multiplicative modification of the valve command, or as a limit on the valve command. In an alternative embodiment, the operator command signal may comprise a speed limit, as opposed to a desired speed based on operator input.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. A method for controllably moving a work implement of a work vehicle having a hydraulic fluid pump for providing fluid flow to the work implement, the work implement including a plurality of work functions that includes a lifting and a lowering function through modulating fluid flow to a hydraulic cylinder through at least one valve, the method comprising:

generating an operator command signal to move the implement on the work vehicle and converting the operator command signal into a speed command signal;

sensing a cylinder speed signal indicative of a speed of a hydraulic cylinder, and generating a corresponding output cylinder velocity signal in response to the speed command signal and the cylinder speed signal;

receiving the output cylinder velocity signal, and generating a corresponding electrical valve signal; and receiving the electrical valve signal and controllably modifying a cross-section of the at least one valve to modulate the fluid flow of the hydraulic cylinder to move the hydraulic cylinder in accordance with the speed command signal.

2. The method of claim 1, wherein the cylinder speed signal is derived from a cylinder position sensor.

3. The method of claim 1, wherein the cylinder speed signal is derived from a state observer.

4. The method of claim 3, wherein the state observer includes an algorithm adapted to run on a controller.

5. The method as set forth in claim 1, further comprises:

sensing a load signal indicative of a load on the hydraulic cylinder, receiving the load signal and generating a corresponding electrical valve signal based on the load signal and the output cylinder velocity signal.

6. The method of claim 1, wherein controllably modifying a cross-section of the valve comprises at least one of modifying a cross-section of a supply valve from the hydraulic fluid pump and modifying a cross-section of a return valve to a fluid tank.

7. The method of claim 1, wherein the fluid flows through at least an open center control valve.

8. The method of claim 1, wherein generating the corresponding electrical valve signal further comprises receiving a signal indicative of an availability of the fluid flow to the hydraulic cylinder.

9. A system for controllably moving a work implement of a work vehicle having a hydraulic fluid pump for providing a fluid flow to the work implement, the system comprising:

at least one operator command tool to produce an operator command signal to move the implement of the work vehicle;

at least one sensor to sense a cylinder speed signal indicative of a speed of a hydraulic cylinder coupled to the implement;

at least one valve to modulate the fluid flow of the hydraulic cylinder; and a controller, having one or more processors that:

process the operator command signal to convert the operator command signal into a speed command signal;

process the cylinder speed signal to generate a corresponding output cylinder velocity signal in response to the speed command signal and the cylinder speed signal; and generate an electrical valve signal corresponding to the output cylinder velocity signal to controllably modify a cross-section of the at least one valve to modulate the fluid flow of the hydraulic cylinder to move the hydraulic cylinder in accordance with the speed command signal.

10. The system of claim 9, wherein the at least one sensor is a cylinder position sensor.

11. The system of claim 9, wherein the at least one sensor is a state observer.

12. The system of claim 9, wherein operator command tool is at least one of a joystick, a button, a touchscreen, and a pedal.

13. The system of claim 9, wherein the valve is at least one of a directional control valve, a proportional control valve, a pressure control valve, and a flow control valve.

14. The system of claim 9, wherein controllably modifying the cross-section of the at least one valve comprises at least one of modifying a cross-section of a supply valve from the hydraulic fluid pump and modifying a cross-section of a return valve to a fluid tank.

15. The system of claim 9, wherein the system further comprises:

at least one load sensor to sense a load signal indicative of a load on the hydraulic cylinder; and wherein the controller further processes the load signal to generate a corresponding output cylinder velocity.

16. The system of claim 9, wherein the system further comprises an open center control valve for fluid flow.

17. The system of claim 9, wherein generating the electrical valve signal further comprises receiving a signal indicative of an availability of the fluid flow to the hydraulic cylinder.

18. A system for controllably moving a work implement of a work vehicle having a hydraulic fluid pump for providing a fluid flow to the work implement, the system comprising:

at least one operator command tool to produce an operator command signal to move the implement of the work vehicle;

at least one cylinder position sensor to sense a cylinder speed signal indicative of a speed of a hydraulic cylinder coupled to the implement;

at least one load sensor to sense a load signal indicative of a load on the hydraulic cylinder a controller, having one more processors that:

process the operator command signal to convert the operator command signal into a speed command signal;

process the cylinder speed signal and load signal to generate a corresponding output cylinder velocity signal in response to the speed command signal, the cylinder speed signal and the load signal; and generate an electrical valve signal corresponding to the output cylinder velocity signal to controllably modify a cross-section of a return valve to a fluid tank.

* * * * *